US005586718A

United States Patent [19]

Speece

[11] Patent Number: 5,586,718

[45] Date of Patent: Dec. 24, 1996

[54] SECURITY MAIL BOX LOCK ASSEMBLY

[75] Inventor: Stephen A. Speece, Youngstown, Ohio

[73] Assignee: Steel City Corporation, Youngstown, Ohio

[21] Appl. No.: 387,316

[22] Filed: Feb. 13, 1995

[51] Int. Cl.[6] ..... B65D 91/00

[52] U.S. Cl. ..... 232/17; 232/41 D

[58] Field of Search ..... 63/17, 41 D; 70/63; 292/341.15, 341.17

[56] References Cited

U.S. PATENT DOCUMENTS

| | | | |
|---|---|---|---|
| 3,802,619 | 4/1974 | Vanderveer . | |
| 4,382,540 | 5/1983 | Kelly et al. . | |
| 4,447,005 | 5/1984 | Kelly | 232/41 D |
| 4,669,764 | 6/1987 | Bruck | 292/341.17 |
| 4,703,635 | 11/1987 | Wyatt . | |
| 4,726,512 | 2/1988 | White | 232/17 |
| 4,815,656 | 3/1989 | Smith et al. . | |
| 5,082,169 | 1/1992 | Aurness et al. . | |
| 5,143,284 | 9/1992 | Socarras . | |
| 5,407,126 | 4/1995 | Coultas | 232/17 |
| 5,476,220 | 12/1995 | Cohoon | 232/41 D |

*Primary Examiner*—Flemming Saether
*Attorney, Agent, or Firm*—Harpman & Harpman

[57] ABSTRACT

A lock assembly for installation on a rural type mail box. The lock installation provides for pre-setting the lock so that the mail person can gain access to the box upon initial door opening. Closing the door activates the lock, locking the box from further access until unlocked by the owner. A spring urged catch is displaced by the lock during pre-set positioning.

6 Claims, 2 Drawing Sheets

SECURITY MAIL BOX LOCK ASSEMBLY

BACKGROUND OF THE INVENTION

1. Technical Field

This device relates to security rural type mail boxes that provide for limited access to the box by only the mail delivery person and the owner.

2. Description of Prior Art

Prior art devices of this type have relied on a variety of complicated locking mechanisms to restrict unauthorized access to lockable mail boxes, see for example U.S. Pat. Nos. 3,802,619, 4,382,540, 4,703,635, 4,815,656, 5,143,284 and 5,082,169.

In U.S. Pat. No. 3,802,619 a spring mounted door and internal pivoted mounted shelf is combined to bar access to the mail box after insertion of mail. A lockable mail removal door is positioned below the mail insert door for removal of the mail by the owner.

U.S. Pat. No. 4,382,540 is directed to a double door lockable mail box wherein the front door may be opened once and thereafter becomes locked.

U.S. Pat. No. 4,703,635 discloses a rural mail box that has a lock assembly mounted on the box and an offset arm positioned on the door. The lock is finger activated by the mail person and then is unlocked by the owner.

A rural mail box is shown in U.S. Pat. No. 4,815,656 having an indicator and a security latch. The indicator position tells the status of the box and its locking door.

U.S. Pat. No. 5,143,284 is directed to a security mail box having an accessible lower compartment and a locked upper compartment divided by an angular divider within the box.

U.S. Pat. No. 5,082,169 discloses a two door lockable mail box with a bottom hinged mail delivery door using multiple cables and rods and springs to lock both doors in sequential fashion.

SUMMARY OF THE INVENTION

A self-locking pre-set single unlocked access locking assembly for rural mail boxes that can be selectively pre-set by the box owner to lock after initial door opening by the mail delivery person. The lock assembly includes a keyed locking cylinder on the door and a spring urged catch mounted within the box. The catch is displaced on pre-setting and returns to lockable engagement position upon opening the door for sequential locking of the door upon further closure.

DESCRIPTION OF THE PREFERRED EMBODIMENT

Figure 1:
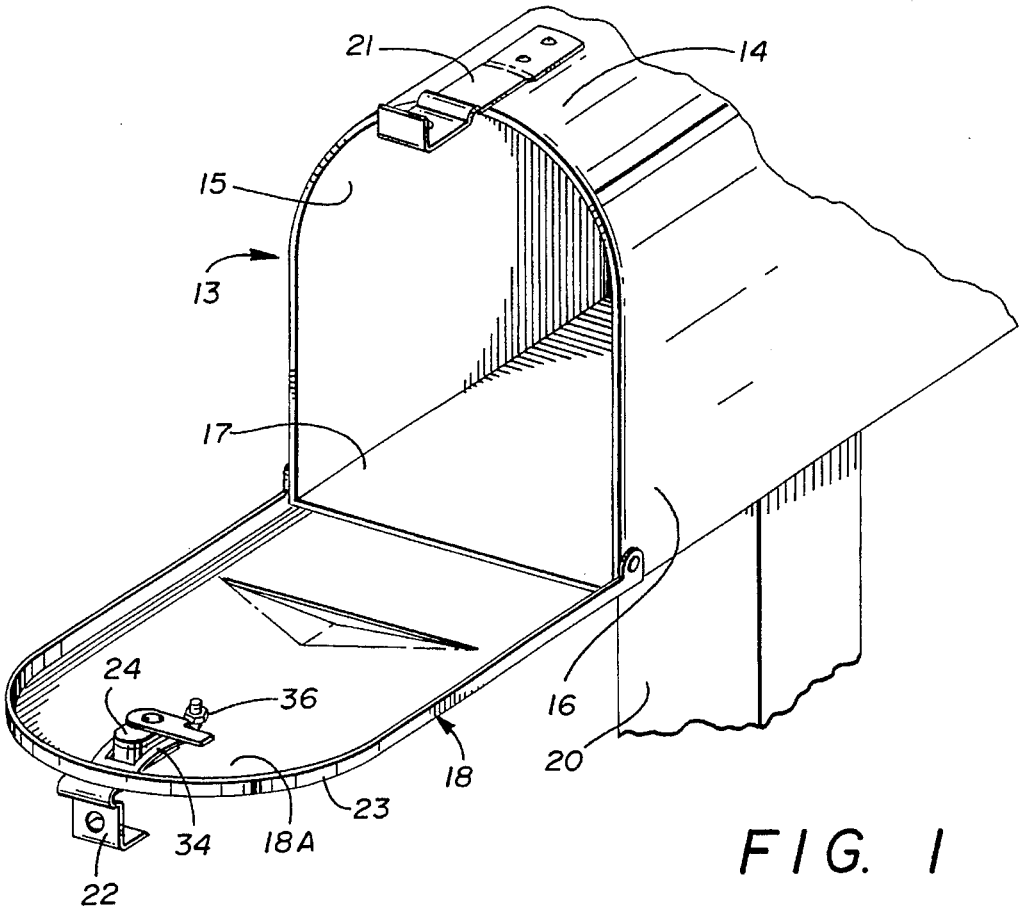
FIG. 1 is a partial perspective view of a mail box with the locking assembly of the invention positioned thereon.
Figure 2:
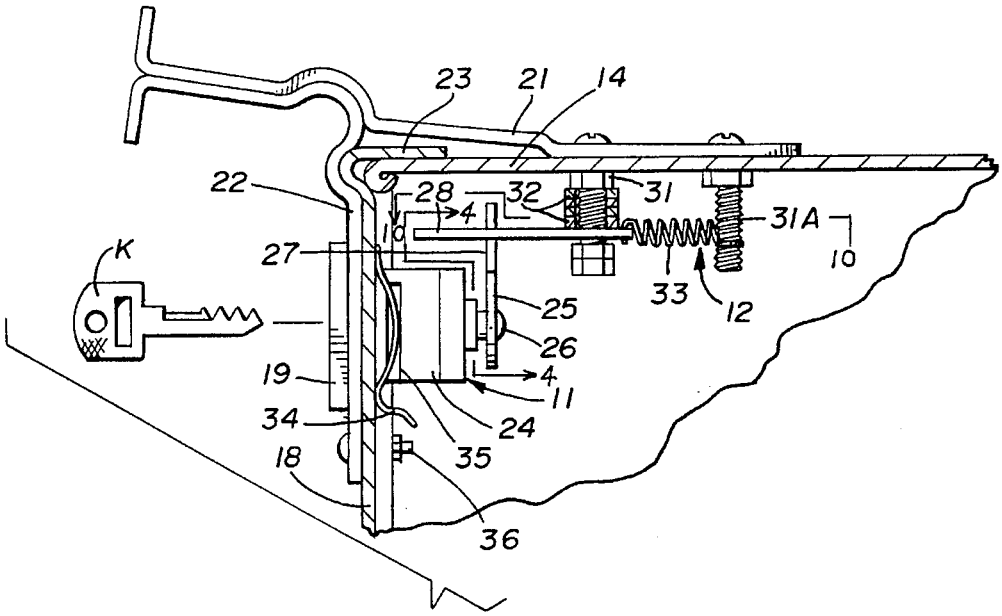
FIG. 2 is an enlarged side elevation view of the locking assembly of the invention with a portion of the mail box broken away.

Referring to FIGS. 1–7 of the drawings, a lock for rural mail boxes can be seen comprising a lock assembly 11 and a catch assembly 12 positioned on a rural mail box 13. The mail box 13 has a curved top wall 14 with integrally depending vertical sidewalls 15 and 16 extending therefrom. A base 17 extends between the respective sidewalls 15 and 16 with a hinged door 18 positioned thereon. Such rural mail boxes 13 are supported by a post 20 and have a frictional latch comprising upper and lower members 21 and 22 secured to the top wall 14 and the door 18 respectively as is well understood by those skilled in the art. The door 18 typically has a curved upstanding flange 23 thereabout so that when closed it overlies the forward margin of the mail box 13 as illustrated in FIG. 2 of the drawings. The lock portion 11 of the invention comprises an outer mounting flange 19 with a locking cylinder 24 extending therefrom. A lock element 25 is secured to the locking cylinder by a fastener 26 as will be well understood by those skilled in the art.

Figure 7:
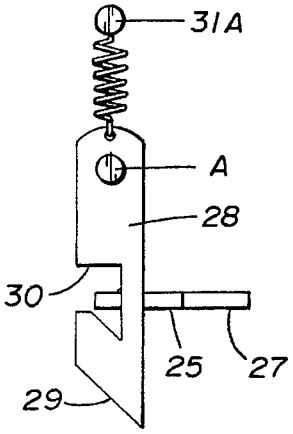
FIG. 7 is a top plan view of the lock assembly shown in FIG. 6.

The lock element 25 defines an offset upstanding tab portion 27 that is engageable with the catch assembly 12 during operation. The catch assembly 12 comprises a generally flat rectangular latch 28 having a mounting and pivot aperture A adjacent one end thereof and a tapered portion 29 extending inwardly from the opposite free end thereof with an angular offset notch 30 formed therein inwardly of said tapered portion 29 as best seen in FIG. 7 of the drawings.

The latch 28 is pivotally secured through its aperture A to the top wall 14 within the mail box 13 by a nut and bolt assembly 31 that extends through the upper member 21 of the frictional catch. Spacers 32 on the nut and bolt assembly 31 position the latch 28 in spaced vertical relation to said top wall 14.

A spring 33 extends from the latch 28 to a second nut and bolt assembly 31A that also extends through the upper member 21 of the frictional latch and the top wall 14 of the mail box securing same thereto.

Referring now to FIGS. 1 and 2 of the drawings, the lock assembly is secured to and through the door 18 by the mounting flange 19 that is engaged directly over the apertured lower member 22 of the hereinbefore described frictional latch with a spring retaining clip 34 engageable in retaining slots 35 of the lock assembly and on the inner surface 18A of the door 18. A fastening nut and bolt 36 extends through aligned apertures in the respective lower member 22 and door 18 completes the mounting assembly.

Figure 3:
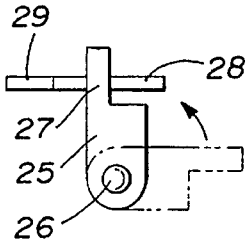
FIG. 3 is a front elevation view of the lock and latch assembly of the invention in pre-set position.
Figure 6:
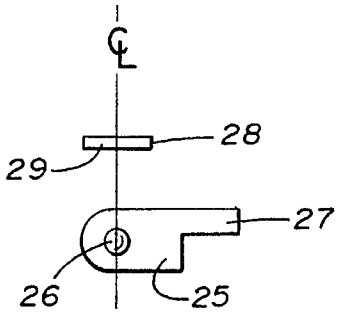
FIG. 6 is a front elevation of the latch assembly in unlocked position.
Figure 8:
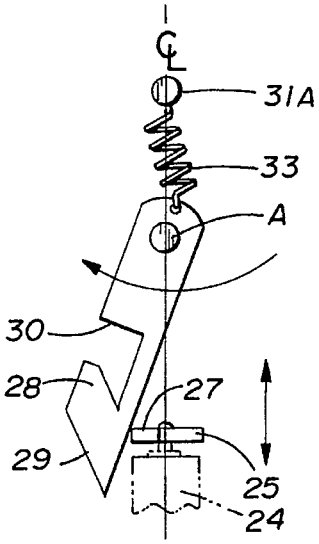
FIG. 8 is a top plan view of the lock assembly shown in FIG. 3.

In operation, the lock assembly is shown in unlocked unset position in FIGS. 6 and 7 of the drawings having the lock element 25 and the tab portion 27 in a horizontal position. To pre-set the lock assembly for auto locking after first access is achieved, the door 18 is initially closed and the lock cylinder is keyed by a key K (seen in FIG. 2 of the drawings) and rotated counter-clockwise moving the lock element 25 to a vertical upstanding position as illustrated in FIGS. 3 and 8 of the drawings so that the tab portion 27 engages and (pivots) moves the latch element 28 to the side as indicated by the directional arrow in FIG. 8 of the drawings. The key K is removed locking the lock element 25 in upright position.

Figure 4:
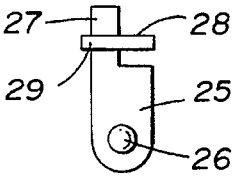
FIG. 4 is a front elevation view of the lock assembly of the invention in locked position.
Figure 9:
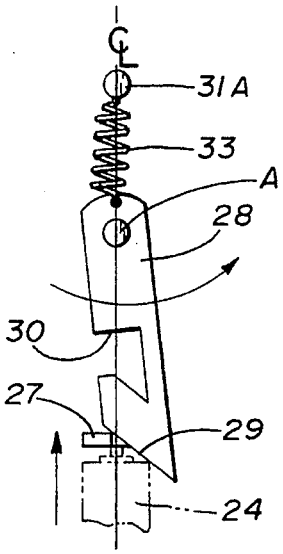
FIG. 9 is a top plan view of the lock assembly illustrating initial displacement of the catch by the returning latch assembly just before locking occurs.
Figure 10:
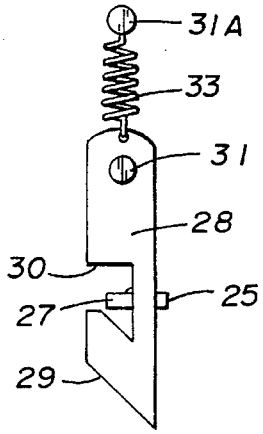
FIG. 10 is a top plan view of the lock assembly shown in FIG. 4.
Figure 11:
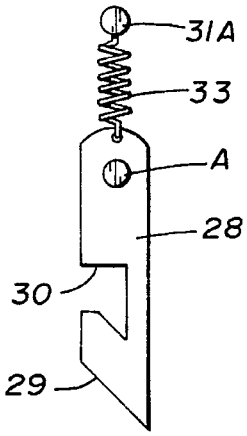
FIG. 11 is a top plan view of the lock assembly shown in a home locked or unlocked position.

When the door 18 is then opened by the mail delivery person, the lock cylinder 24 of the lock assembly 11 moves away disengaging from the spring urged latch 28 which returns to its home position illustrated in FIG. 11. After delivery, the mail delivery person closes the door, as the door is closed the tab portion 27 re-engages the latch 28 on its tapered portion 29 displacing (pivoting) the latch 28 as indicated by the directional arrow in FIG. 9 of the drawings. When the door 18 is fully closed in this sequence as seen in FIGS. 2, 4, and 10 of the drawings, the tab 27 is engaged within the notch 30, thus preventing unauthorized opening of the door 18.

Figure 5:
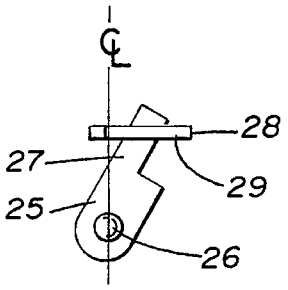
FIG. 5 is a front elevational view of the lock assembly of the invention being unlocked.

To unlock the door 18, the locking cylinder is keyed by the key K and rotated clockwise as indicated by the directional arrow in FIG. 5 of the drawings displacing (pivoting) the latch 28 to the right until the tab portion 27 slip under the latch 28 whereupon the tab portion 27 continues clockwise rotation to the unlocked unset position and the spring urged latch 28 returns to its home position as seen in FIGS. 6 and 7.

Thus it will be seen that a unique locking sequence has been achieved by the invention which allows for initial access to the mail box and then automatically locks the door upon closure after initial access.

This pre-setting and locking sequence is achieved with a single locking cylinder element and a simple spring urged biased position latch catch all of which is supported and assembled by existing mounting hardware used to mount the frictional latch typically found on these types of mail boxes.

Thus it will be seen that a new and useful device has been illustrated and described and that it will be apparent to those skilled in the art that various changes and modifications may be made therein without departing from the spirit of the invention.

Therefore I claim:

1. A mail box lock assembly securing a door of a rural mail box in a closed position, said rural mail box having cooperating frictional members on said door and said mail box, said lock comprising; a catch assembly and a lock assembly, said lock assembly comprising a cylinder keyed lock having a lock element with an engagement tab portion extending in planar relation therefrom, said lock element movable from a first locked and pre-set position to a second unlocked position, said catch assembly comprising a latch pivotally secured to said mail box, said latch having a tapered portion on its free end and a locking notch inwardly thereof, spring means on said latch and means for mounting said lock assembly to the door and means for pivotally securing said catch assembly to said mail box wherein, in the pre-set position the tab portion is engageable on a side of said latch opposite said notch such that said mail box door is in said closed position.

2. The lock of claim 1 wherein said locking notch is engageable by said tab portion of said lock element in locked door closed position.

3. The lock of claim 1 wherein said tab portion on said lock element is offset from the central pivoted axis of said lock element.

4. The lock of claim 1 wherein said means for mounting said lock assembly to said inner side of the door comprises a mounting flange on said lock assembly and a retaining clip registerable on said locking cylinder.

5. The lock of claim 1 wherein said means for pivotally securing said catch assembly to said mail box comprises a nut and bolt assembly in one of said cooperating frictional latch members of said mail box.

6. The lock of claim 1 wherein said latch is engageable by said tab portion of said lock element in pre-set door closed position.

* * * * *